US011085652B2

(12) United States Patent
Sawai et al.

(10) Patent No.: US 11,085,652 B2
(45) Date of Patent: Aug. 10, 2021

(54) CEILING CONCEALED INDOOR UNIT AND AIR-CONDITIONING APPARATUS EQUIPPED THEREWITH

(71) Applicant: Mitsubishi Electric Corporation, Tokyo (JP)

(72) Inventors: Megumi Sawai, Tokyo (JP); Tetsuya Tazawa, Tokyo (JP); Keisuke Tomomura, Tokyo (JP); Hironobu Suehiro, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 132 days.

(21) Appl. No.: 16/462,982

(22) PCT Filed: Feb. 9, 2017

(86) PCT No.: PCT/JP2017/004702
§ 371 (c)(1),
(2) Date: May 22, 2019

(87) PCT Pub. No.: WO2018/146763
PCT Pub. Date: Aug. 16, 2018

(65) Prior Publication Data
US 2020/0063984 A1 Feb. 27, 2020

(51) Int. Cl.
*F24F 1/0047* (2019.01)
*F24F 13/20* (2006.01)
*F24F 13/32* (2006.01)

(52) U.S. Cl.
CPC ..... *F24F 1/0047* (2019.02); *F24F 13/20* (2013.01); *F24F 13/32* (2013.01)

(58) Field of Classification Search
CPC ..... F24F 13/32; F24F 13/0254; F24F 13/20; F24F 1/0047; F24F 1/0007
See application file for complete search history.

(56) References Cited

U.S. PATENT DOCUMENTS 6,393,856 B1 * 5/2002 Gunji ..... F24F 1/0011 62/298
10,460,872 B2 * 10/2019 Kinoshita ..... H01G 2/04
2001/0035023 A1 * 11/2001 Kuo ..... F24F 13/20 62/412

(Continued)

FOREIGN PATENT DOCUMENTS

CN 100453911 C * 1/2009
EP 3032185 A1 6/2016

(Continued)

OTHER PUBLICATIONS

International Search Report of the International Searching Authority dated May 16, 2017 for the corresponding International application No. PCT/JP2017/004702 (and English translation).

(Continued)

*Primary Examiner* — Nelson J Nieves
(74) *Attorney, Agent, or Firm* — Posz Law Group, PLC

(57) ABSTRACT

A ceiling concealed indoor unit and an air-conditioning apparatus equipped therewith includes a body; and a body decorative panel installed below the body, in which the body decorative panel includes a pair of guide ribs disposed to be opposite to each other and adapted to accept passage of a rail of an auxiliary decorative panel coupled to the body decorative panel.

10 Claims, 7 Drawing Sheets

(56) References Cited

U.S. PATENT DOCUMENTS

| | | | | |
|---|---|---|---|---|
| 2006/0283204 | A1* | 12/2006 | Kuo | F24F 1/0047 62/419 |
| 2009/0025414 | A1* | 1/2009 | Koga | F24F 13/20 62/263 |
| 2009/0188268 | A1* | 7/2009 | Cho | F24F 1/0047 62/259.1 |
| 2009/0193769 | A1* | 8/2009 | Mun | F24F 1/0047 55/289 |
| 2011/0319009 | A1* | 12/2011 | Nam | F24F 1/0007 454/256 |
| 2014/0167405 | A1* | 6/2014 | Lahey | F24F 13/32 285/64 |
| 2015/0090429 | A1* | 4/2015 | Jeong | F24F 1/0047 165/121 |
| 2015/0105013 | A1* | 4/2015 | Jeong | F25D 27/005 454/293 |
| 2016/0313021 | A1* | 10/2016 | Nakamura | F24F 13/22 |
| 2017/0045259 | A1* | 2/2017 | Choi | F24F 1/0022 |
| 2017/0191676 | A1* | 7/2017 | Jeong | F24F 13/20 |
| 2017/0191677 | A1* | 7/2017 | Jeong | F24F 11/89 |
| 2021/0025602 | A1* | 1/2021 | Fuse | F24F 13/06 |

FOREIGN PATENT DOCUMENTS

| | | | | | |
|---|---|---|---|---|---|
| JP | S63-078821 | U | | 5/1988 | |
| JP | H07-091684 | A | | 4/1995 | |
| JP | H11-325578 | A | | 11/1999 | |
| JP | 2000-046365 | A | | 2/2000 | |
| JP | 2004-101013 | A | | 4/2004 | |
| JP | 2009041779 | A | * | 2/2009 | F24F 1/0047 |
| JP | 2013-145074 | A | | 7/2013 | |
| JP | 2016109310 | A | * | 6/2016 | F24F 13/1413 |
| KR | 20080052973 | A | * | 6/2008 | |
| KR | 101403694 | B1 | * | 6/2014 | |

OTHER PUBLICATIONS

Examination Report dated Jul. 30, 2020 issued in corresponding IN patent application No. 201947028868.

* cited by examiner

CEILING CONCEALED INDOOR UNIT AND AIR-CONDITIONING APPARATUS EQUIPPED THEREWITH

CROSS REFERENCE TO RELATED APPLICATION

This application is a U.S. national stage application of PCT/JP2017/004702 filed on Feb. 9, 2017, the contents of which are incorporated herein by reference.

TECHNICAL FIELD

The present invention relates to a ceiling concealed indoor unit and an air-conditioning apparatus equipped therewith, and more particularly, to a decorative panel used for the ceiling concealed indoor unit for an air-conditioning apparatus.

BACKGROUND ART

Conventionally, a ceiling concealed indoor unit for an air-conditioning apparatus has a body made up of a box-shaped outer sheet-metal shell, where the ceiling concealed indoor unit is embedded above a ceiling through an opening provided in the ceiling. At a lower opening of the body, the ceiling concealed indoor unit is equipped with a decorative panel (hereinafter referred to as a body decorative panel) exposed to an indoor space (see, for example, Patent Literature 1).

When a ceiling concealed indoor unit is replaced with an indoor unit larger in size, the new indoor unit may differ in size from the opening provided in the ceiling, which results in an excess clearance between the indoor unit and ceiling. A ceiling concealed indoor unit is disclosed in which an auxiliary decorative panel is attached to a body decorative panel of an indoor unit to hide the excess clearance between the indoor unit and ceiling, (see, for example, Patent Literature 2). The ceiling concealed indoor unit of Patent Literature 2 is structured to be able to create decorative panels of different sizes by connecting an auxiliary decorative panel of another size to a body decorative panel of a minimum size.

CITATION LIST

Patent Literature

Patent Literature 1: Japanese Unexamined Utility Model Application Publication No. 63-078821

Patent Literature 2: Japanese Unexamined Patent Application Publication No. 2000-46365

SUMMARY OF INVENTION

Technical Problem

The decorative panel used for the ceiling concealed indoor unit is exposed to the indoor space. Therefore, in assembling the auxiliary decorative panel to the body decorative panel, it is necessary to eliminate a level difference between the body decorative panel and auxiliary decorative panel or otherwise eliminate factors that would spoil design. In the ceiling concealed indoor unit of Patent Literature 2, a locking bracket is securely mounted in a ceiling space, thereby fixing the auxiliary decorative panel to the body decorative panel. This may make it difficult to ensure accuracy of assembly of the body decorative panel and auxiliary decorative panel to avoid design being spoiled.

The present invention has been made to overcome the above problem and has an object to provide a ceiling concealed indoor unit that achieves sufficient assembly accuracy in assembling an auxiliary decorative panel to a body decorative panel as well as providing an air-conditioning apparatus equipped therewith.

Solution to Problem

A ceiling concealed indoor unit for an air-conditioning apparatus according to an embodiment of the present invention comprises: a body; and a body decorative panel installed below the body, wherein the body decorative panel includes a pair of guide ribs disposed to be opposite to each other, between which a rail of an auxiliary decorative panel is inserted, the auxiliary decorative panel being coupled to the body decorative panel.

Advantageous Effects of Invention

The ceiling concealed indoor unit for an air-conditioning apparatus according to an embodiment of the present invention comprises a body; and a body decorative panel installed below the body, wherein the body decorative panel includes a pair of guide ribs disposed to be opposite to each other, between which a rail of an auxiliary decorative panel is inserted, the auxiliary decorative panel being coupled to the body decorative panel. Consequently, the ceiling concealed indoor unit and an air-conditioning apparatus equipped therewith can be provided as products with high accuracy of assembling between the body decorative panel and auxiliary decorative panel because movement of the rail in a width direction is restricted, with the rail acting as a coupling portion between the body decorative panel and auxiliary decorative panel.

DESCRIPTION OF EMBODIMENTS

Figure 1:
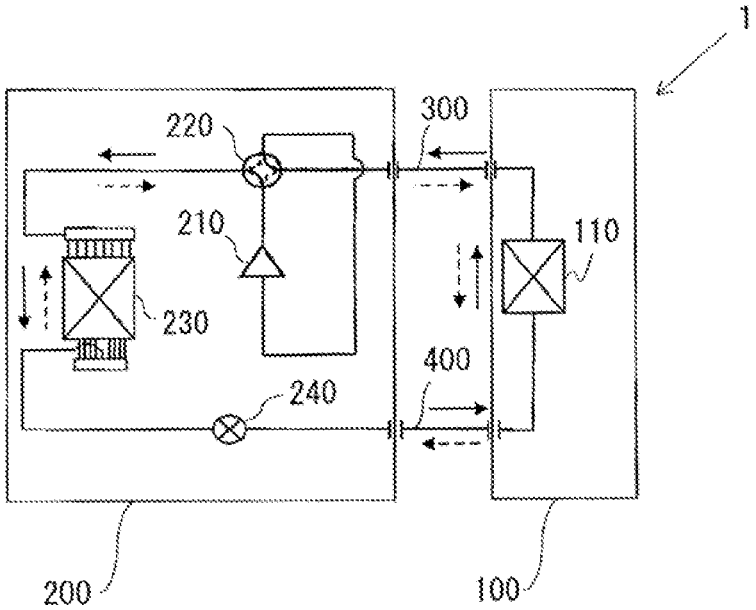
FIG. 1 is a diagram showing an example configuration of an air-conditioning apparatus according to Embodiment 1 of the present invention.

A ceiling concealed indoor unit and an air-conditioning apparatus equipped therewith according to embodiments of the present invention will be described below with reference to the drawings. In the drawings described below, the components denoted by the same reference numerals are same or equivalent components and are common throughout the embodiment described below. Besides, the forms of the components described throughout the specification are strictly exemplary, and the components are not limited to the forms described herein. In particular, combinations of components are not limited to those described in any of the embodiments, and components described in one embodiment may be applied to another embodiment. Also, in the drawings, components may not be shown in their true size relations.

Embodiment 1

FIG. 1 is a diagram showing an example configuration of an air-conditioning apparatus according to Embodiment 1 of the present invention. Here, FIG. 1 shows an air-conditioning apparatus 1 as an example of a refrigeration cycle apparatus. The air-conditioning apparatus 1 of FIG. 1 includes an outdoor unit 200 and a ceiling concealed indoor unit 100, which are connected by pipes including gas refrigerant pipes 300 and liquid refrigerant pipes 400.

The outdoor unit 200 includes a compressor 210, a flow switching device 220, an outdoor heat exchanger 230, and an expansion valve 240. The compressor 210 compresses and discharges suctioned refrigerant. Here, although this is not restrictive, the compressor 210 may be designed to be able to change its capacity (an amount of refrigerant delivered per unit time), for example, by changing operation frequency as desired under control of an inverter circuit or other circuits. The flow switching device 220, which is, for example, a four-way valve, switches a direction of a refrigerant flow path by switching between cooling operation and heating operation of the air-conditioning apparatus 1. The outdoor heat exchanger 230 exchanges heat between refrigerant and air (outdoor air). During heating operation, functioning as an evaporator, the outdoor heat exchanger 230 evaporates/vaporizes the refrigerant. On the other hand, during cooling operation, functioning as a condenser, the outdoor heat exchanger 230 condenses and liquefies the refrigerant. The expansion valve 240, which is an expansion device (a flow control unit), regulates a flow rate of refrigerant flowing through the expansion valve 240, and functions as an expansion valve to decompress the refrigerant flowing into the expansion valve 240. For example, when made up of an electronic expansion valve or other similar valves, the expansion valve 240 adjusts its opening degree on instructions from a controller (not shown).

The ceiling concealed indoor unit 100 includes an indoor heat exchanger 110. The indoor heat exchanger 110 exchanges heat between the air to be conditioned and the refrigerant. During heating operation, functioning as a condenser, the indoor heat exchanger 110 condenses and liquefies the refrigerant. On the other hand, during cooling operation, functioning as an evaporator, the indoor heat exchanger 110 evaporates/vaporizes the refrigerant.

Figure 2:
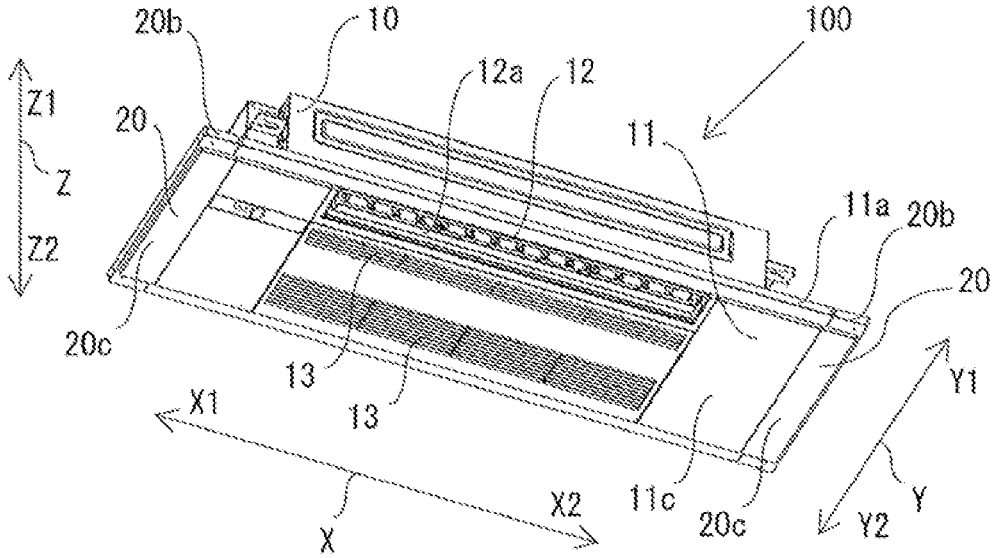
FIG. 2 is a perspective view showing a ceiling concealed indoor unit for the air-conditioning apparatus according to Embodiment 1 of the present invention.

FIG. 2 is a perspective view showing the ceiling concealed indoor unit for the air-conditioning apparatus according to Embodiment 1 of the present invention. The X axis shown in FIG. 2 corresponds to a lengthwise direction of the ceiling concealed indoor unit 100, the Y axis corresponds to a widthwise direction of the ceiling concealed indoor unit 100, and the Z axis corresponds to a height direction of the ceiling concealed indoor unit 100. Note that on the Z axis, Z1 indicates an upward direction or a ceiling side and Z2 indicates a downward direction or an indoor side.

The ceiling concealed indoor unit 100 is a ceiling concealed air-conditioning apparatus installed above the ceiling of a room. The ceiling concealed indoor unit 100 includes a body 10 equipped with an indoor heat exchanger 110 (not shown) and a body decorative panel 11 installed below the body 10. The ceiling concealed indoor unit 100 further includes auxiliary decorative panels 20 coupled to the body decorative panel 11. In FIG. 2, the auxiliary decorative panels 20 have been assembled to opposite ends of the body decorative panel 11 in the lengthwise direction (X-axis direction) of the ceiling concealed indoor unit 100.

Figure 3:
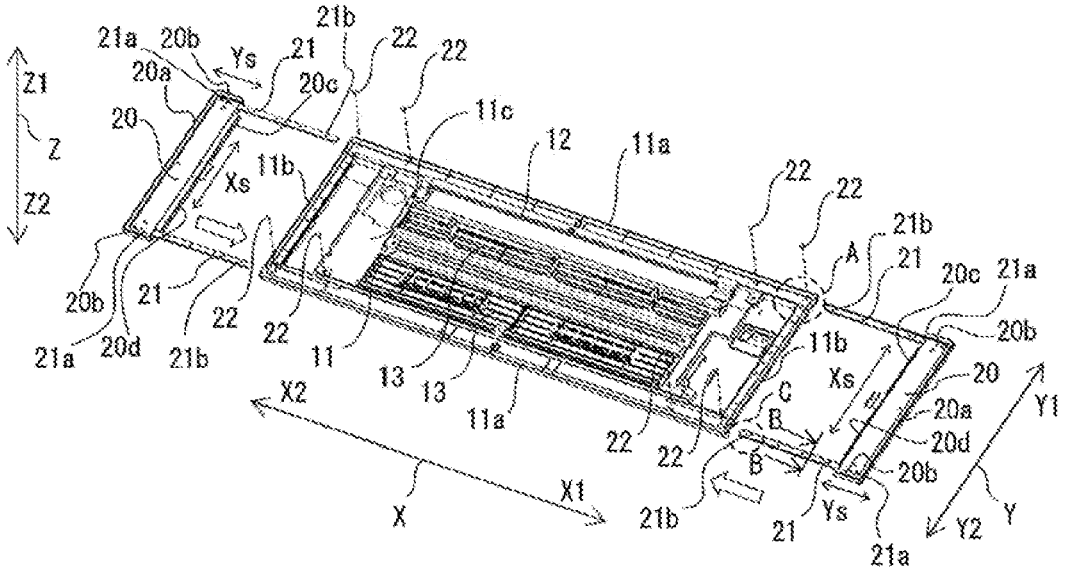
FIG. 3 is an exploded perspective view showing a decorative panel used for the ceiling concealed indoor unit for the air-conditioning apparatus according to Embodiment 1 of the present invention as viewed in the direction from viewed in the direction from a body.

FIG. 3 is an exploded perspective view showing a decorative panel used for the ceiling concealed indoor unit for the air-conditioning apparatus according to Embodiment 1 of the present invention as viewed in the direction from viewed in the direction from a body of the indoor unit. In FIG. 3, the brank arrows indicate insertion directions of rails 21 provided on the auxiliary decorative panels 20 into the body decorative panel 11. Note that the body 10 is omitted in FIG. 3 to show a configuration of the decorative panel clearly.

As shown in FIG. 3, the body decorative panel 11 comprises long-side walls 11*a* opposite to each other, short-side walls 11*b* opposite to each other, and a bottom face portion 11*c* formed into a rectangular shape in a planar view when viewed in the direction from the body 10. The body decorative panel 11 is rectangular in a planar view. Note that a lengthwise direction (X-axis direction), widthwise direction (Y-axis direction), and height direction (Z-axis direction) of the body decorative panel 11 agree with the lengthwise direction (X-axis direction), widthwise direction (Y-axis direction), and height direction (Z-axis direction) of the ceiling concealed indoor unit 100 shown in FIG. 2 described above.

A suction port 13 is provided near a center of the body decorative panel 11 to suction indoor air into the body 10. Also, in the body decorative panel 11, on a first side (Y1 side) in the widthwise direction of the body decorative panel 11, an air outlet 12 for use to blow air out of the body 10 is provided along the lengthwise direction (X-axis direction) of the body decorative panel 11. Note that the location of the air outlet 12 is not limited to the first side (Y1 side) in the widthwise direction of the body decorative panel 11, and the air outlet 12 may be provided on a second side (Y2 side) in the widthwise direction of the body decorative panel 11. Also, the location of the air outlet 12 is not limited to either side in the widthwise direction of the body decorative panel 11, and may be both sides (Y1 side and Y2 side) in the widthwise direction of the body decorative panel 11. As shown in FIG. 2, an airflow direction flap 12*a* is placed at the position of the air outlet 12 to vary a direction of air blown out of the body 10. Note that the airflow direction flap 12*a* is omitted in FIG. 3 to show a configuration of the decorative panel clearly.

Figure 4:
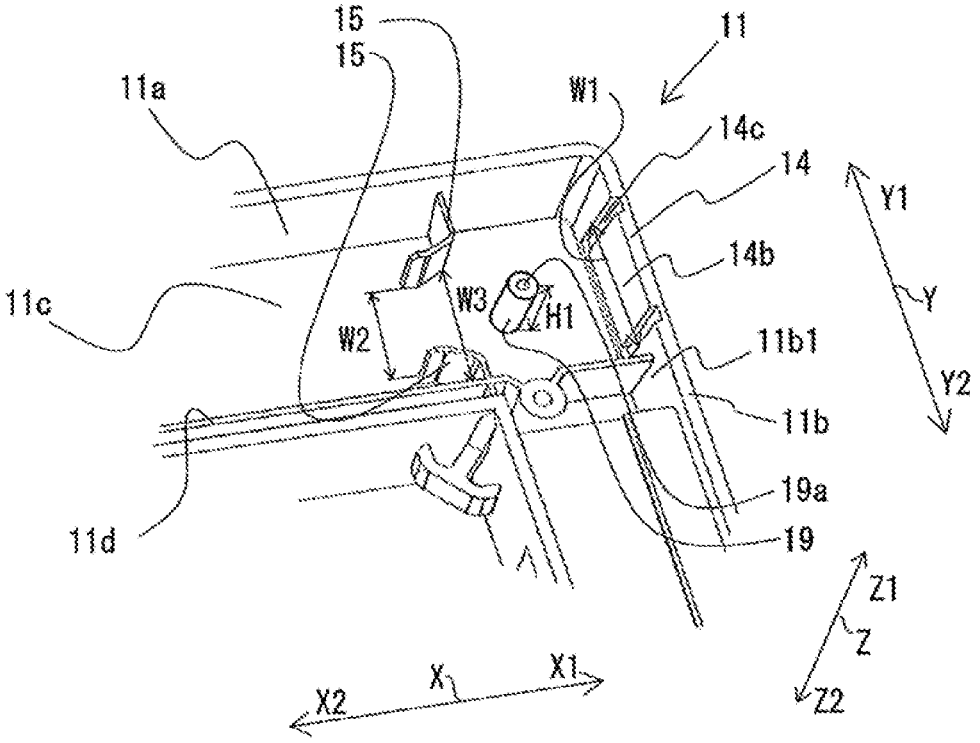
FIG. 4 is an enlarged view of part A in a body decorative panel shown in FIG. 3.
Figure 5:
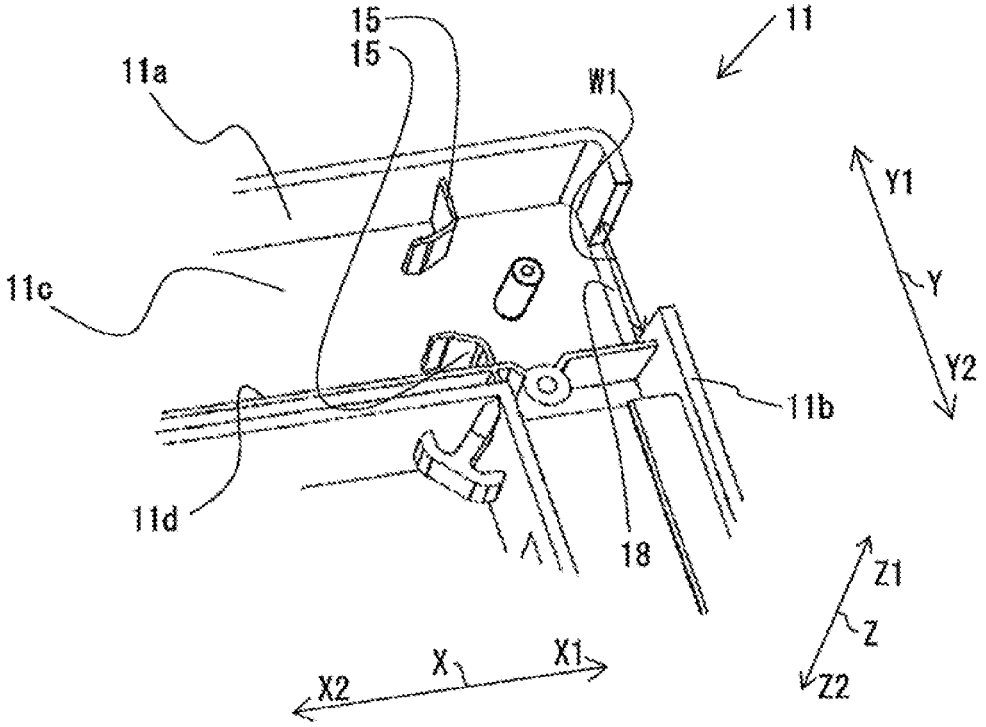
FIG. 5 is an enlarged view of FIG. 4 with a knockout portion removed.

FIG. 4 is an enlarged view of part A in a body decorative panel shown in FIG. 3. FIG. 5 is an enlarged view of FIG. 4 with a knockout portion removed. As shown in FIG. 4, the body decorative panel 11 has plural knockout portions 14 at the short-side walls 11*b*. Also, the body decorative panel 11 includes pairs of guide ribs 15 between which the rails 21 of the auxiliary decorative panels 20 is inserted, the auxiliary decorative panel being coupled to the body decorative panel 11, the guide ribs in each pair being disposed to be opposite to each other. Furthermore, bosses 19 for use to fix the rails 21 with screws are provided on the bottom face portion 11*c* of the body decorative panel 11.

The knockout portion 14 is a partially cutout piece in a wall of the body decorative panel 11 and can be forced out easily on site to produce a hole, for example, by knocking or cutting out. Knockout portions 14 are provided on opposite sides (Y1 side and Y2 side) of the short-side walls 11*b*. Also, the knockout portions 14 are provided at the short-side walls 11*b* opposite to each other, and the knockout portions 14 provided in the short-side walls 11*b* are provided in positions opposite to each other. Note that because the knockout portions 14 provided at the short-side walls 11*b* have a same structure, the structure of the knockout portions 14 will be described with reference to FIGS. 4 and 5 without distinguishing between the knockout portions 14 by positions at which the knockout portions 14 are provided.

Each of the knockout portions 14 includes a removable plate 14*b* configured to be removed to form a through-hole 18, as shown in FIG. 5, in the short-side wall 11*b*, and grooves 14*c* formed around the removable plate 14*b* in the short-side wall 11*b*. That is, the removable plate 14*b* to be removed from the short-side wall 11*b* makes up part of the short-side wall 11*b* before removal. The grooves 14*c* are formed in inside surfaces 11*b*1 of the short-side walls 11*b* opposite to each other. The grooves 14*c* are recesses formed at the short-side walls 11*b* and are those portions of the short-side walls 11*b* that have a smaller wall thickness. When the removable plate 14*b* is removed from the short-side wall 11*b* along the grooves 14*c*, the knockout portion 14 forms the through-hole 18 with a width of W1 in the short-side wall 11*b* by penetrating inner and outer sides of the body decorative panel 11. The width W1 of the through-hole 18 is larger than a width W4 of the rails 21 described later. However, to assemble the auxiliary decorative panels 20 accurately to the body decorative panel 11, desirably the width W1 of the through-hole 18 is set as close as possible to the width W4 of the rail described later.

Figure 6:
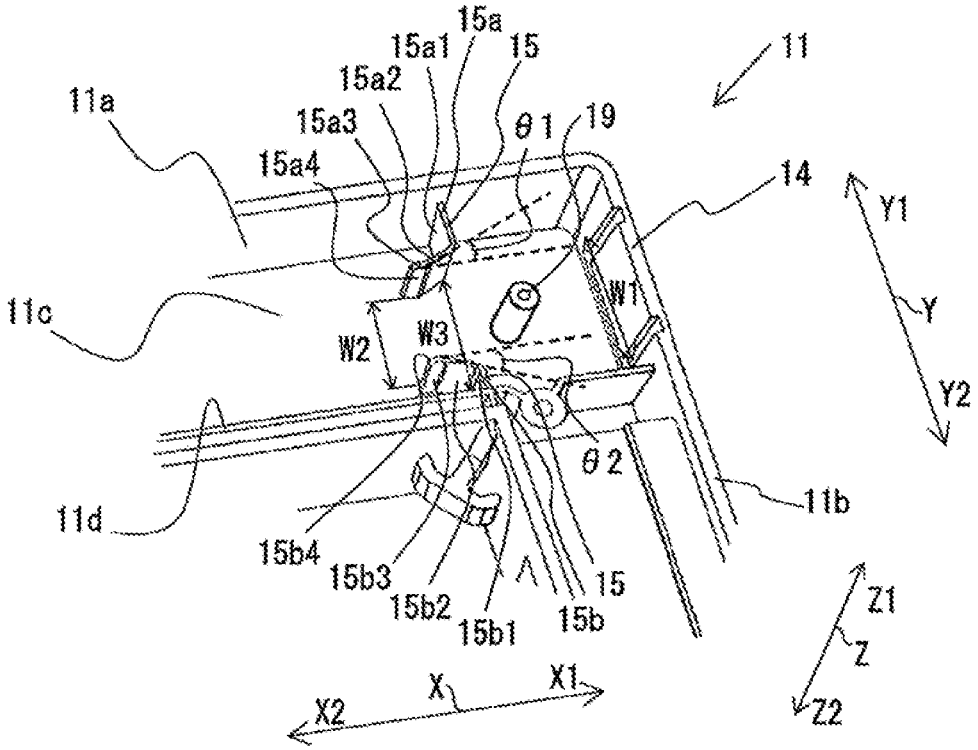
FIG. 6 is a partial enlarged view explaining a pair of guide ribs shown in FIG. 4.

FIG. 6 is a partial enlarged view explaining a pair of guide ribs shown in FIG. 4. The pair of guide ribs 15 restricts movement of the rails 21 of the auxiliary decorative panel 20 in the width direction (Y-axis direction) of the rails 21. The pair of guide ribs 15 are provided for each of the knockout portions 14. A guide rib 15*a* and guide rib 15*b* making up the pair of guide ribs 15 are placed in the widthwise direction (Y-axis direction) between each long-side wall 11*a* of the body decorative panel 11 and an inner wall 11*d* opposite to the long-side wall 11*a*. The guide rib 15*a* is fixed to the long-side wall 11*a* and bottom face portion 11*c*. Also, the guide rib 15*b* is fixed to the inner wall 11*d* and bottom face portion 11*c*. The pair of guide ribs 15 are structured to sandwich the rail 21 inserted between the guide ribs 15*a* and 15*b* when the body decorative panel 11 and auxiliary decorative panel 20 are coupled together. The body decorative panel 11 has plural pairs of guide ribs 15 in the lengthwise direction (X-axis direction) of the body decorative panel 11.

The guide ribs 15*a* and 15*b* are plate-like formations. The guide rib 15*a* includes a base 15*a*1, an intermediate portion 15*a*2, and a regulating portion 15*a*3. The guide rib 15*a* is formed such that the base 15*a*1, intermediate portion 15*a*2, and regulating portion 15*a*3 will be arranged in this order in the lengthwise direction (X-axis direction) of the body decorative panel 11 from the closest short-side wall 11*b* to the short-side wall 11*b* on the opposite side. The guide rib 15*b* includes a base 15*b*1, an intermediate portion 15*b*2, and a regulating portion 15*b*3. The guide rib 15*a* is formed such that the base 15*b*1, intermediate portion 15*b*2, and regulating portion 15*b*3 will be arranged in this order in the lengthwise direction (X-axis direction) of the body decorative panel 11 from the closest short-side wall 11*b* to the short-side wall 11*b* on the opposite side. Since guide ribs 15*a* and 15*b* are formed in a plate-like shape, the amount of material to be used therefor can be reduced and thereby the material cost can be reduced.

The bases 15*a*1 and 15*b*1 are provided in the widthwise direction (Y-axis direction) of the body decorative panel 11 in a planar view. The base 15*a*1 is fixed to a long-side wall 11*a* and the bottom face portion 11*c*. The base 15*b*1 is fixed to the inner wall 11*d* and the bottom face portion 11*c*.

The regulating portion 15*a*3, which is a front end portion of the guide rib 15*a*, is fixed to the bottom face portion 11*c* and provided to be opposite to the long-side wall 11*a*. The regulating portion 15*b*3, which is a front end portion of the guide rib 15*b*, is fixed to the bottom face portion 11*c* and provided to be opposite to the inner wall 11*d*. A regulating surface 15*a*4 of the regulating portion 15*a*3 and a regulating surface 15*b*4 of the regulating portion 15*b*3 are configured to be opposite to each other. The pair of guide ribs 15 are disposed such that a width W2 between the regulating surfaces 15*a*4 and 15*b*4 will be larger than the width W4 of the rails 21 described later. However, to assemble the auxiliary decorative panels 20 accurately to the body decorative panel 11, desirably the width W2 between the regulating surfaces 15*a*4 and 15*b*4 is set as close as possible to the width W4 of the rail.

The intermediate portion 15*a*2 connects the base 15*a*1 and regulating portion 15*a*3 with each other and is fixed to the bottom face portion 11*c*. Also, the intermediate portion 15*a*2 is connected to the regulating portion 15*a*3 at an angle θ1. The intermediate portion 15*b*2 connects the base 15*b*1 and regulating portion 15*b*3 with each other and is fixed to the bottom face portion 11*c*. Also, the intermediate portion 15*b*2 is connected to the regulating portion 15*b*3 at an angle θ2. The angles θ1 and θ2 are larger than 0 degrees and smaller than 90 degrees. Thus, the intermediate portions 15*a*2 and 15*b*2 are provided at angles to the short-side wall 11*b* in a planar view. Besides, a maximum width W3 between the intermediate portions 15*a*2 and 15*b*2 is located on the side of the closest knockout portion 14. The maximum width W3 between the intermediate portions 15*a*2 and 15*b*2 is configured to be larger than the width W2 between the regulating surfaces 15*a*4 and 15*b*4. In other words, the pair of guide ribs 15 are provided at a distance from each other, the distance increasing as a distance to the knockout portion 14 closest to the pair of guide ribs 15 decreases. Also, the maximum width W3 between the intermediate portions 15*a*2 and 15*b*2 is configured to be larger than the width W1 of the through-hole 18 in the knockout portion 14.

Although the intermediate portion 15*a*2 is illustrated as being a flat plate in FIG. 4, the intermediate portion 15*a*2 may be structured to connect the base 15*a*1 and regulating portion 15*a*3 with each other by having an arc shape in a planar view. Similarly, although the intermediate portion 15*b*2 is illustrated as being a flat plate, the intermediate portion 15*b*2 may be structured to connect the base 15*b*1 and regulating portion 15*b*3 with each other by having an arc shape in a planar view. Even if the guide ribs 15*a* and 15*b* have such a structure, the pair of guide ribs 15 are provided at a distance from each other, the distance increasing as a distance to the knockout portion 14 closest to the pair of guide ribs 15 decreases.

The bosses 19 are used to fix the rails 21 of the auxiliary decorative panel 20 thereto with screws 22 shown in FIG. 3. As shown in FIG. 4, each of the bosses 19 is formed in a cylindrical shape with a height of H1 and with a projection formed thereon pointing toward the ceiling, and a screw hole 19*a* is formed inside the cylinder. Note that instead of being formed in a cylindrical shape, the boss 19 may be formed in a prismatic shape. The screw hole 19*a* may be internally threaded in advance or an internal thread may be cut when an external screw is inserted. Plural bosses 19 are provided along the lengthwise direction (X-axis direction) of the body decorative panel 11 in positions opposite to the knockout portions 14. The number of bosses 19 to be formed is not fixed, and can be determined, for example, by taking the size or weight of the body decorative panel 11 and auxiliary decorative panel 20 into consideration.

Referring back to FIG. 3, the auxiliary decorative panel 20 will be described. The auxiliary decorative panels 20 are assembled and coupled to the body decorative panel 11, thereby expanding the decorative panel used for the ceiling concealed indoor unit 100. Each of the auxiliary decorative panel 20 is formed in a rectangular shape in a planar view. The auxiliary decorative panel 20 includes a long-side wall 20*a*, short-side walls 20*b* opposite to each other, and a bottom face portion 20*c* formed in a rectangular shape in a planar view. As shown in FIG. 3, the auxiliary decorative panel 20 is placed such that a lengthwise direction (Xs-axis direction) of the auxiliary decorative panel 20 agree with the widthwise direction (Y-axis direction) of the ceiling concealed indoor unit 100 and that the widthwise direction (Ys-axis direction) of the auxiliary decorative panel 20 agree with the lengthwise direction (X-axis direction) of the ceiling concealed indoor unit 100. When the auxiliary decorative panels 20 and body decorative panel 11 are coupled together, each side wall 20*d* made up of the short-side walls 20*b* and bottom face portion 20*c* of the auxiliary decorative panel 20 comes into contact with the short-side wall 11*b* of the body decorative panel 11. When the auxiliary decorative panels 20 and body decorative panel 11 are coupled together, the long-side walls 11*a* of the body decorative panel 11 are flush with the short-side walls 20*b* of the auxiliary decorative panels 20 as shown in FIG. 2. Also, with the auxiliary decorative panels 20 and body decorative panel 11 being coupled together, the bottom face portion 11*c* of the body decorative panel 11 is flush with the bottom face portions 20*c* of the auxiliary decorative panels 20 as shown in FIG. 2.

As shown in FIG. 3, each of the auxiliary decorative panels 20 is provided with two rails 21 opposite to each other on opposite ends in the lengthwise direction (Xs-axis direction) of the auxiliary decorative panel 20. The rails 21 are designed to couple the auxiliary decorative panel 20 to the body decorative panel 11. Also, the rails 21 function as members guided by the guide ribs 15. The rails 21 are configured such that base end portions 21*a* are fixed in a region surrounded by the long-side wall 20*a*, short-side walls 20*b* opposite to each other, and bottom face portion 20*c* of the auxiliary decorative panel 20 while front end portions 21*b* protrude from the auxiliary decorative panel 20. The rails 21 protrude from the auxiliary decorative panel 20, and when the auxiliary decorative panel 20 is coupled to the body decorative panel 11, the rails 21 are inserted between the guide ribs 15 in the pairs of the guide ribs 15 by passing through the through-holes 18.

Figure 7:
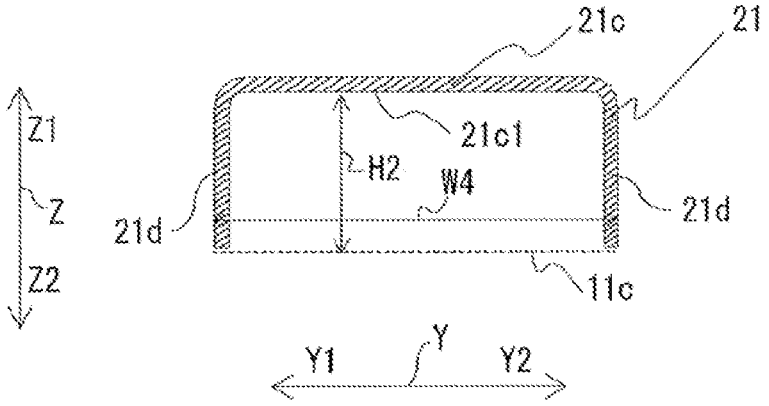
FIG. 7 is a sectional view taken along line B-B in FIG. 3.

FIG. 7 is a sectional view taken along line B-B in FIG. 3. The sectional view taken along line B-B in FIG. 3 is a cross-sectional view in an axial direction of the rail 21. As shown in the sectional view of FIG. 7, in a cross-section perpendicular to the axial direction of the rail 21, the rail 21 includes a ceiling wall 21*c* and side walls 21*d* rising from opposite ends of the ceiling wall 21*c*. With the auxiliary decorative panels 20 and body decorative panel 11 being coupled together, the rail 21 is configured such that a height H2 from the bottom face portion 11*c* of the body decorative panel 11 to a ceiling surface 21*c*1 making up an undersurface of the ceiling wall 21*c* will be larger than the height H1 of the boss shown in FIG. 4. Since the height H2 of each rail 21 is configured to be larger than the height H1 of the boss when the auxiliary decorative panels 20 and body decorative panel 11 are coupled together, the rails 21 can be inserted smoothly into the body decorative panel 11. The rail 21 is configured such that the width W4 of the rail 21 is smaller than the width W1 of the through-hole 18 in the knockout portion 14. Also, the width W4 of the rail 21 is configured to be smaller than the width W2 between the regulating surfaces 15*a*4 and 15*b*4. However, to assemble the auxiliary decorative panels 20 accurately to the body decorative panel 11, desirably the width W4 of the rail is configured to be as close as possible to the width W1 of the through-hole 18 in the knockout portion 14. Also, desirably the width W4 of the rail is configured to be as close as possible to the width W2 between the regulating surfaces 15*a*4 and 15*b*4.

Figure 8:
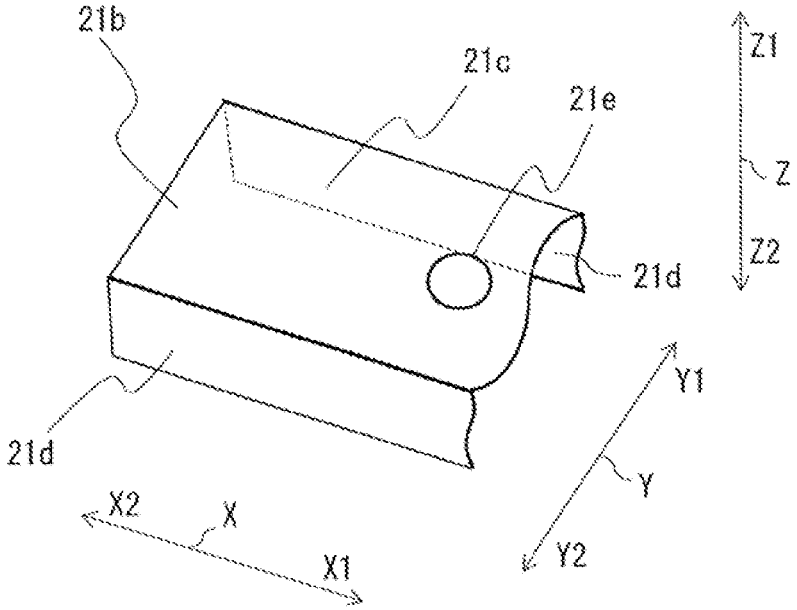
FIG. 8 is a simplified partial enlarged view of part C in a rail shown in FIG. 3.
Figure 9:
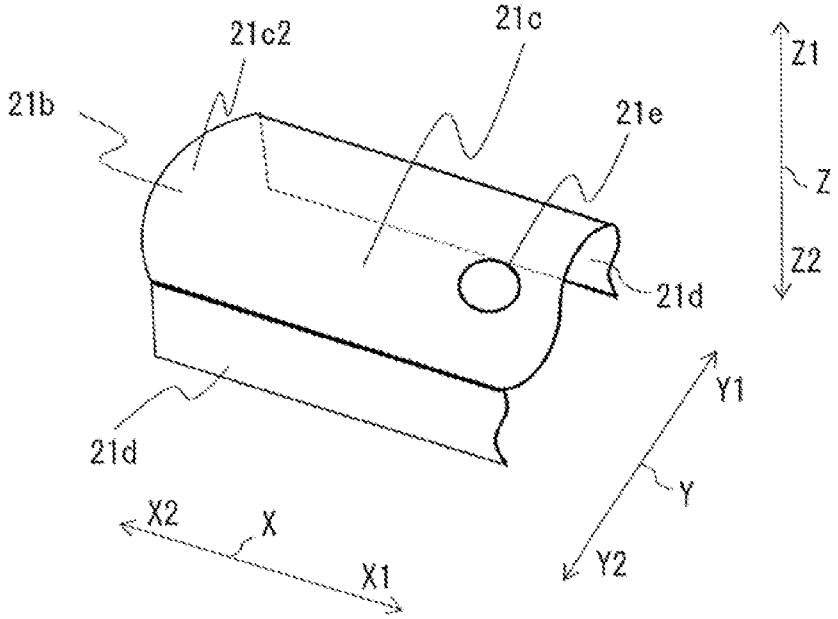
FIG. 9 is a modification of a front end portion of the rail shown in FIG. 8.

FIG. 8 is a simplified partial enlarged view of part C in a rail shown in FIG. 3. FIG. 9 is a modification of a front end portion of the rail shown in FIG. 8. As shown in FIG. 8, the rail 21 is formed of the ceiling wall 21*c* and the side walls 21*d* opposite to each other, and the front end portion 21*b* of the rail 21 has corners in a planar view. To make it easy to insert the front end portion 21*b* of the rail 21 between the pair of guide ribs 15, the shape of the front end portion 21*b* having corners in a planar view may be changed. For example, FIG. 9 is a modification of the front end portion 21*b* of the rail 21, in which the ceiling wall 21*c* includes a ceiling protrusion 21*c*2 protruding toward the front end of the rail 21 by having an arc shape in a planar view.

The rail 21 has plural openings 21*e* along the axial direction of the rail 21. Locations of the openings 21*e* agree with locations of the screw holes 19*a* in the bosses 19 when the auxiliary decorative panel 20 and body decorative panel 11 are coupled together. Note that the openings 21*e* are through-holes, but may be formed as blind holes, which are pierced, for example, by applying a screw point to the blind holes and turning the screw while pressing down the screw.

Figure 10:
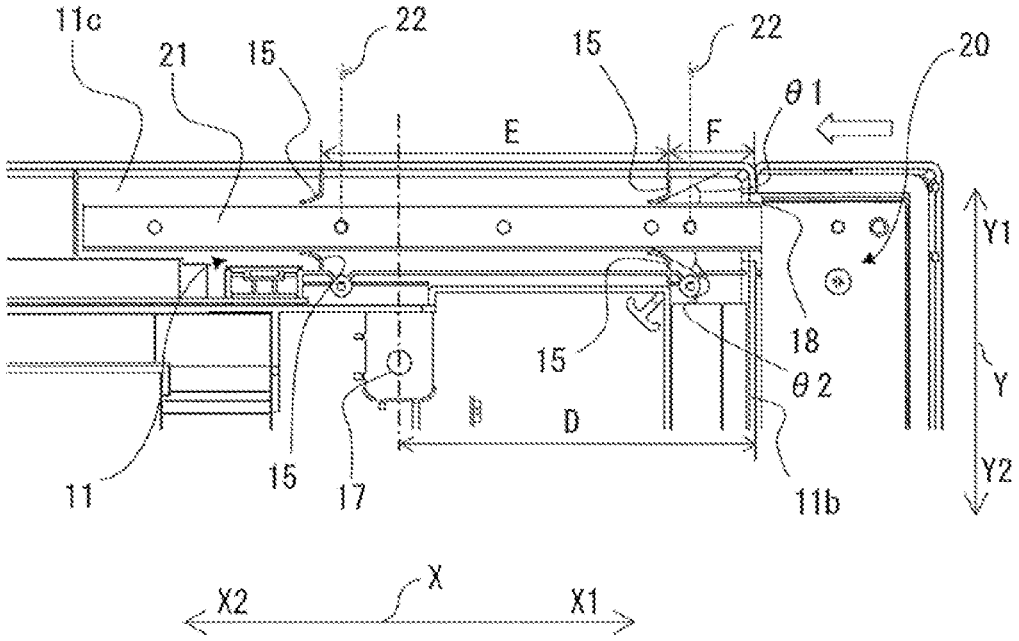
FIG. 10 is a sectional view of principal part showing a coupled state after assembly of the body decorative panel and an auxiliary decorative panel.

FIG. 10 is a sectional view of principal part showing a coupled state after assembly of the body decorative panel and auxiliary decorative panel. In FIG. 10, the brank arrow indicates the insertion direction of the rails 21 into the body decorative panel 11. The pairs of guide ribs 15 are disposed on the body decorative panel 11 such that in the insertion direction of the rails 21, a distance E between a first pair of guide ribs 15 and a second pair of guide ribs 15 is larger than a distance F from the short-side wall 20*b* to the first pair of guide ribs 15. Also, with the auxiliary decorative panel 20 and body decorative panel 11 being coupled together, a length of the rails 21 is larger than a distance D between the short-side wall 20*b* and a mounting hole 17 used to mount the body decorative panel 11 on the body 10.

Next, assembling between the body decorative panel 11 and auxiliary decorative panels 20 will be described. To assemble and couple together the body decorative panel 11 and auxiliary decorative panels 20, first a user removes the knockout portions 14 provided at the short-side walls 11*b* of the body decorative panel 11 by forcing out the removable plates 14*b* from the short-side walls 11*b* along the grooves 14*c* using a tool such as a hammer.

Next, the user inserts the rails 21 of the auxiliary decorative panel 20 into the through-holes 18 in the knockout portions 14. In so doing, since the height H2 of the rail 21 shown in FIG. 7 is larger than the height H1 of the boss 19 shown in FIG. 4, the rails 21 can be inserted without interference with the bosses 19.

Then, the user further inserts the rails 21 of the auxiliary decorative panel 20 between the pair of guide ribs 15 on the body decorative panel 11. In the lengthwise direction (X-axis direction) of the body decorative panel 11, the pair of guide ribs 15 are provided at a distance from each other, the distance increasing as the distance to the knockout portion 14 closest to the pair of guide ribs 15 decreases. This makes it easy for the user to insert the rails 21 into the body decorative panel 11 through the through-holes 18.

Subsequently, the user aligns screw holes 19*a* formed in the bosses 19 with the openings 21*e* formed in the rails 21 and co-fastens the body decorative panel 11 and the rails 21 of the auxiliary decorative panel 20 using the screws 22. When the screws 22 are fixed to the screw holes 19*a* through the openings 21*e*, the rails 21 are fixed to the bosses 19 and the auxiliary decorative panel 20 is coupled to the body decorative panel 11. Note that the auxiliary decorative panel 20 is removed by reversing the assembly procedure.

Thus, the ceiling concealed indoor unit 100 and air-conditioning apparatus 1 include pairs of guide ribs 15 between which the rails 21 of the auxiliary decorative panels 20 is inserted, the auxiliary panel being coupled to the body decorative panel 11, the guide ribs 15 in each pair being disposed to be opposite to each other. Consequently, because movement of the rails 21, which serve as coupling portions between the body decorative panel 11 and auxiliary decorative panels 20, is restricted in a width direction, the ceiling concealed indoor unit 100 and air-conditioning apparatus 1 can be provided as products with high accuracy of assembling between the body decorative panel 11 and auxiliary decorative panels 20.

Also, in the ceiling concealed indoor unit 100 and air-conditioning apparatus 1, with the accuracy of assembling between the body decorative panel 11 and auxiliary decorative panels 20 being improved, the long-side walls 11*a* of the body decorative panel 11 are flush with the short-side walls 20*b* of the auxiliary decorative panels 20 without any level difference. Furthermore, in the ceiling concealed indoor unit 100 and air-conditioning apparatus 1, the bottom face portion 11*c* of the body decorative panel is flush with the bottom face portions 20*c* of the auxiliary decorative panels 20 without any level difference. Besides, with the ceiling concealed indoor unit 100 and air-conditioning apparatus 1, when the body decorative panel 11 and auxiliary decorative panels 20 are flush with each other, design consistency between the body decorative panel 11 and auxiliary decorative panels 20 can be ensured.

Also, the ceiling concealed indoor unit 100 and air-conditioning apparatus 1 are configured such that the pairs of guide ribs 15 are provided at a distance from each other, the distance increasing as the distance to the knockout portion 14 closest to the pair of guide ribs 15 decreases. This allows the user to insert the rails 21 easily into the body decorative panel 11 through the through-holes 18 and guide the rails 21 accurately into place using the pairs of guide ribs 15. This in turn can provide the ceiling concealed indoor unit 100 and air-conditioning apparatus 1 that allow the user to assemble the body decorative panel 11 and auxiliary decorative panels 20 with high assembly efficiency.

Also, the body decorative panel 11 is rectangular in a planar view, and has plural pairs of guide ribs 15 in the lengthwise direction (X-axis direction) of the body decorative panel 11. Consequently, by increasing the number of locations where the rails 21 are sandwiched, the ceiling concealed indoor unit 100 and air-conditioning apparatus 1 can prevent degradation of assembly accuracy due to forming accuracy of any pair of guide ribs 15. Also, by increasing the number of locations where the rails 21 are sandwiched, the ceiling concealed indoor unit 100 and air-conditioning apparatus 1 can correct any angular displacement occurring during insertion of the rails 21. Furthermore, the ceiling concealed indoor unit 100 and air-conditioning apparatus 1, which have plural pairs of guide ribs 15 in the lengthwise direction (X-axis direction) of the body decorative panel 11, can prevent twisting and deflection of the body decorative panel 11 and increase rigidity of the body decorative panel 11.

Also, the body decorative panel 11 has knockout portions 14 at the short-side walls 11*b*. With the ceiling concealed indoor unit 100 and air-conditioning apparatus 1, the rails 21 can be inserted by forming the through-holes 18 in the body decorative panel 11 only when auxiliary decorative panels 20 are assembled to the body decorative panel 11. Consequently, the ceiling concealed indoor unit 100 and air-conditioning apparatus 1 enables commonality of the body decorative panel 11 without distinguishing between the body decorative panel 11 to which the auxiliary decorative panels 20 are assembled and the body decorative panel 11 to which the auxiliary decorative panels 20 are not assembled.

Also, each knockout portion 14 comprises a removable plate 14*b* configured to form a through-hole 18 in the short-side wall 11*b* when removed, and grooves 14*c* formed around the removable plate 14*b* in the short-side wall 11*b*. Also, the grooves 14*c* are formed in inside surfaces 11*b*1 of the short-side walls 11*b* opposite to each other. Consequently, when the user looks at the body decorative panel 11 not coupled with the auxiliary decorative panels 20, the user cannot see the grooves 14*c* from indoors, and thus external design is not spoiled when the body decorative panel 11 is used without the auxiliary decorative panels 20.

Also, each auxiliary decorative panel 20 includes the rails 21 configured to protrude from the auxiliary decorative panel 20 and inserted between the guide ribs 15 in the pairs of the guide ribs 15 by passing through the through-holes 18. Consequently, the ceiling concealed indoor unit 100 and air-conditioning apparatus 1 allow the auxiliary decorative panels 20 coupled to the body decorative panel 11. Also, the ceiling concealed indoor unit 100 and air-conditioning apparatus 1 improve the accuracy of assembling between the body decorative panel 11 and auxiliary decorative panels 20 and allow the user to assemble the body decorative panel 11 and auxiliary decorative panels 20 with high assembly efficiency.

Also, in a cross-section perpendicular to the axial direction of the rail 21, each rail 21 includes the ceiling wall 21*c* and the side walls 21*d* rising from opposite ends of the ceiling wall 21*c*. Consequently, in the ceiling concealed indoor unit 100 and air-conditioning apparatus 1, the rails 21 have increased strength in the axial direction and sectional direction as well as increased twisting strength.

Also, the ceiling wall 21*c* includes the ceiling protrusion 21*c*2 protruding toward the front end of the rail 21 by having an arc shape in a planar view. Consequently, with the ceiling concealed indoor unit 100 and air-conditioning apparatus 1, when the user inserts the rails 21 into the through-holes 18, the front ends of the rail 21 are less liable to get caught on wall surfaces of the guide ribs 15*a* and 15*b*. Consequently, the user can pass the rails 21 smoothly through the pairs of guide ribs 15.

Also, the length of the rails 21 is larger than the distance D between the short-side wall 11*b* and the mounting hole 17 used to mount the body decorative panel 11 on the body 10. Therefore, in the insertion direction of the rails 21, the ceiling concealed indoor unit 100 and air-conditioning apparatus 1 allow the second pair of guide ribs 15 to be placed at a distance greater than the distance D, and thereby allow the distance E to be extended. Consequently, the ceiling concealed indoor unit 100 and air-conditioning apparatus 1 allow each of the rails 21 to be inserted through the pairs of guide ribs 15 to be arranged with reduced shift in its widthwise direction (Y-axis direction). As a result, the ceiling concealed indoor unit 100 and air-conditioning apparatus 1 allow level differences at junctions between the auxiliary decorative panels 20 and body decorative panel 11 to be reduced, improving the accuracy of assembling between the body decorative panel 11 and auxiliary decorative panels 20.

Also, the pairs of guide ribs 15 are disposed on the body decorative panel 11 such that in the insertion direction of the rails 21, the distance E between the first pair of guide ribs 15 and the second pair of guide ribs 15 is larger than the distance F from the short-side wall 20*b* to the first pair of guide ribs 15. Consequently, the ceiling concealed indoor unit 100 and air-conditioning apparatus 1 allow the rails 21 passed through the pairs of guide ribs 15 to be reduced in slope width in the widthwise direction (Y-axis direction). As a result, the ceiling concealed indoor unit 100 and air-conditioning apparatus 1 allow level differences at junctions between the auxiliary decorative panels 20 and body decorative panel 11 to be reduced, improving the accuracy of assembling between the body decorative panel 11 and auxiliary decorative panels 20. Also, any angular displacement occurring during insertion of the rails 21 can be corrected.

The ceiling concealed indoor unit and the air-conditioning apparatus equipped therewith according to Embodiment 1 of the present invention have been described, and now modifications of the body decorative panel 11 will be described with reference to FIGS. 11 to 13. Components having the same configurations as the corresponding components of the air-conditioning apparatus shown in FIGS. 1 to 10 are denoted by the same reference numerals as the corresponding components, and description thereof will be omitted. Also, the modifications of the body decorative panel 11 have the same advantageous effects as those described above.

Figure 11:
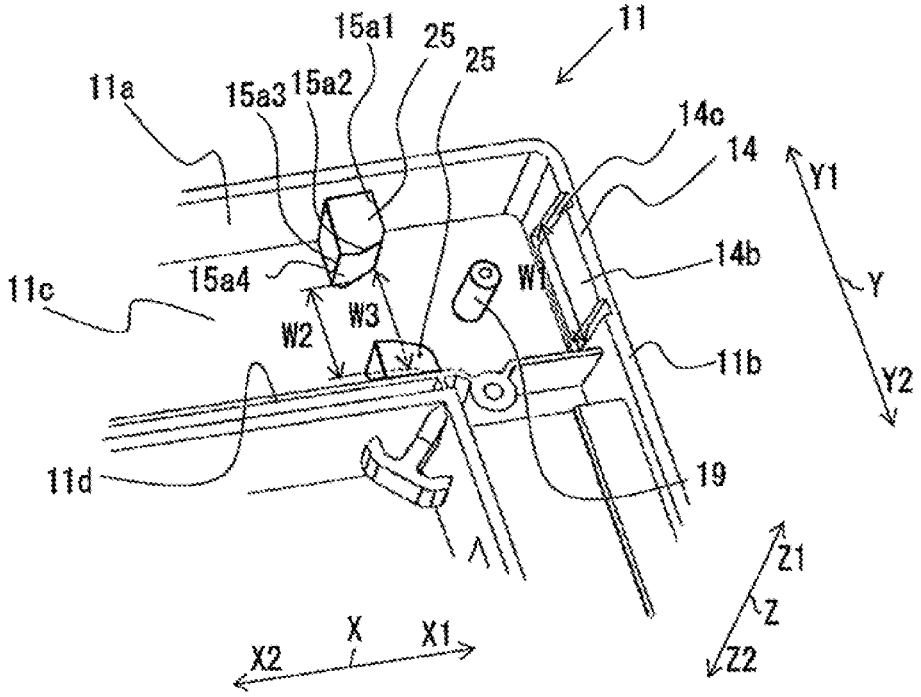
FIG. 11 is an enlarged view showing a modification of the body decorative panel.

FIG. 11 is an enlarged view showing a modification of the body decorative panel. The pair of guide ribs 25 are provided for each of the knockout portions 14. Whereas the pair of guide ribs 15 described above are formed in a plate-like shape, the pair of guide ribs 25 are formed in a prismatic shape having thicknesses in the lengthwise direction (X-axis direction) and height direction (Z-axis direction) of the body decorative panel 11. Having a thickness in the lengthwise direction (X-axis direction) of the body decorative panel 11, the pair of guide ribs 25 have strength in the insertion direction of the rails 21. Consequently, even if the user inserts the rails 21 strongly, there is less fear that the pairs of guide ribs 25 will be broken, and the rails 21 can be led to an appropriate position. Also, having thicknesses in the lengthwise direction (X-axis direction) and height direction (Z-axis direction) of the body decorative panel 11, the pairs of guide ribs 25 can further prevent twisting and deflection of the body decorative panel 11 and increase rigidity of the body decorative panel 11.

Figure 12:
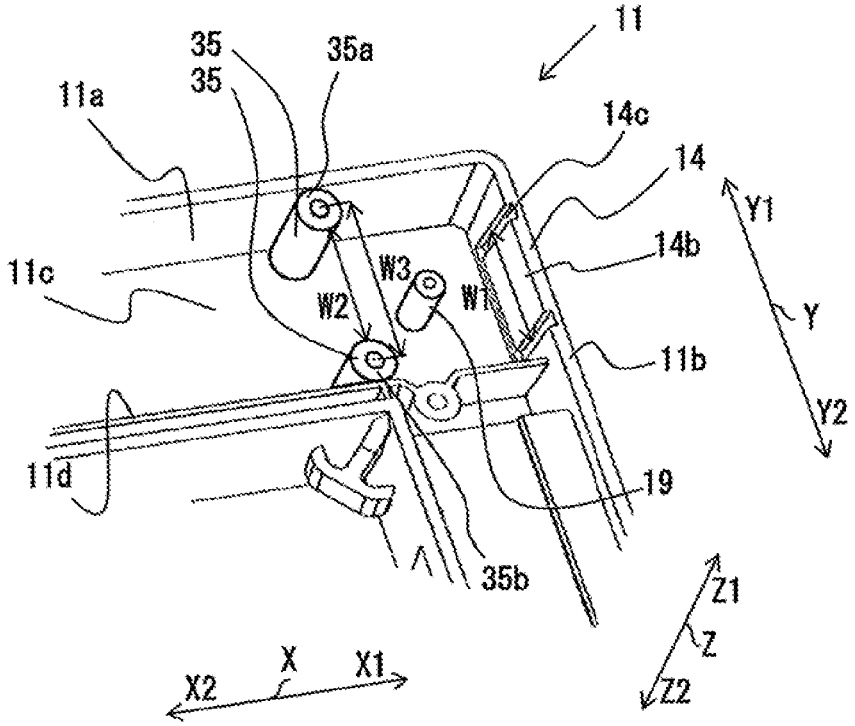
FIG. 12 is an enlarged view showing another modification of the body decorative panel.

FIG. 12 is an enlarged view showing another modification of the body decorative panel. Components having the same configurations as the corresponding components of the air-conditioning apparatus shown in FIGS. 1 to 10 are denoted by the same reference numerals as the corresponding components, and description thereof will be omitted. Whereas the pair of guide ribs 15 described above are formed in a plate-like shape, a pair of guide ribs 35 are formed in the shape of a hollow circular cylinder. The pair of guide ribs 35 are provided for each of the knockout portions 14. A guide rib 35*a* and guide rib 35*b* making up the pair of guide ribs 35 are placed in the widthwise direction (Y-axis direction) between each long-side wall 11*a* of the body decorative panel 11 and the inner wall 11*d* opposite to the long-side wall 11*a*. Peripheral walls of the guide ribs 35*a* and 35*b* are formed of curved surfaces. Therefore, opposite surfaces of the guide ribs 35*a* and 35*b* provided at a distance from each other, the distance increasing as a distance to one of the knockout portion 14 closest to the pair of guide ribs 35 decreases. Consequently, the user can insert the rails 21 smoothly through the pairs of guide ribs 35. Also, being circular cylinders, the pair of guide ribs 35 have high strength in a radial direction. This can increase the strength of the guide ribs 35 against collisions with the rails 21. Note that although the guide ribs 35*a* and 35*b* are illustrated as being hollow circular cylinders in FIG. 12, the guide ribs 35*a* and 35*b* may be solid circular cylinders.

Figure 13:
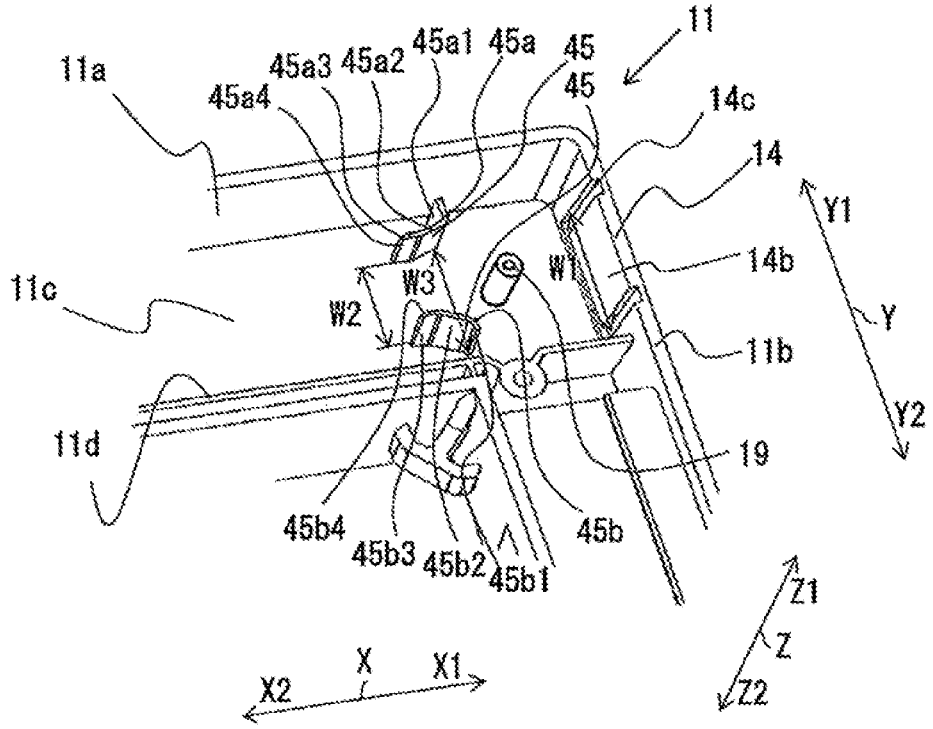
FIG. 13 is an enlarged view showing still another modification of the body decorative panel.

FIG. 13 is an enlarged view showing still another modification of the body decorative panel. Components having the same configurations as the corresponding components of the air-conditioning apparatus shown in FIGS. 1 to 10 are denoted by the same reference numerals as the corresponding components, and description thereof will be omitted. The pair of guide ribs 45 are provided for each of the knockout portions 14. The base 15*a*1 of the guide rib 15*a* described above is fixed to a long-side wall 11*a* and the bottom face portion 11*c*. Also, the base 15*b*1 of the guide rib 15*b* is fixed to the inner wall 11*d* and the bottom face portion 11*c*. In contrast, a base 45*a*1 of a guide rib 45*a* is fixed only to the bottom face portion 11*c*, and not to the long-side wall 11*a*. Also, a base 45*b*1 of a guide rib 45*b* is fixed only to the bottom face portion 11*c*, and not to the inner wall 11*d*. That is, the pair of guide ribs 45 is provided on the bottom face portion 11*c*. Having intermediate portions 45*a*2 and 45*b*2, the pair of guide ribs 45 make it easy to insert the rail 21, and regulating portions 45*a*3 and 45*b*3 allow the pair of guide ribs 45 to restrict movement of the rail 21 in the width direction (Y-axis direction). A regulating surface 45*a*4 of the regulating portion 45*a*3 and regulating surface 45*b*4 of the regulating portion 45*b*3 are configured to be opposite to each other. The pair of guide ribs 45 are disposed such that a width W2 between the regulating surfaces 45*a*4 and 45*b*4 is larger than the width W4 of the rail 21.

Embodiment 2

Figure 14:
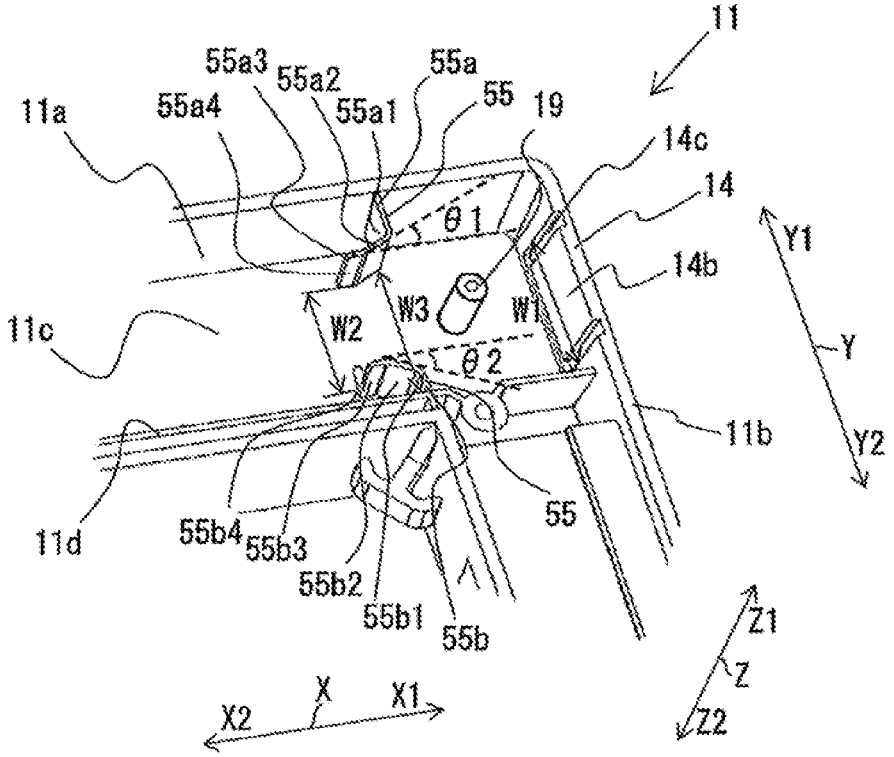
FIG. 14 is an enlarged view showing a body decorative panel used for a ceiling concealed indoor unit for an air-conditioning apparatus according to Embodiment 2 of the present invention.

FIG. 14 is an enlarged view showing a body decorative panel used for a ceiling concealed indoor unit for an air-conditioning apparatus according to Embodiment 2 of the present invention. Components having the same configurations as the corresponding components of the air-conditioning apparatus shown in FIGS. 2 to 13 are denoted by the same reference numerals as the corresponding components, and description thereof will be omitted. The pair of guide ribs 55 are provided for each of the knockout portions 14. The pair of guide ribs 15 of the air-conditioning apparatus according to Embodiment 1 of the present invention described above are fixed to the long-side wall 11*a* or inner wall 11*d* of the body decorative panel 11 as well as to the bottom face portion 11*c*. In contrast, the pair of guide ribs 55 of the air-conditioning apparatus according to Embodiment 2 of the present invention are fixed to the long-side wall 11*a* or inner wall 11*d* of the body decorative panel 11.

The pair of guide ribs 55 are intended to restrict movement of the rails 21 of the auxiliary decorative panel 20 in the width direction (Y-axis direction) of the rails 21. The pair of guide ribs 55 are made of an elastic material such as a resinous material and are deformable under pressure. The pair of guide ribs 55 comprise a first guide rib 55*a* fixed to the long-side wall 11*a* and a second guide rib 55*b* fixed to the inner wall 11*d* opposite to the long-side wall 11*a*. The pair of guide ribs 55 are structured to sandwich the rail 21 inserted between the first guide rib 55*a* and second guide rib 55*b* when the body decorative panel 11 and auxiliary decorative panel 20 are coupled together. Also, the body decorative panel 11 has plural pairs of guide ribs 55 in the lengthwise direction (X-axis direction) of the body decorative panel 11.

The first guide rib 55*a* and second guide rib 55*b* are plate-like formations. The first guide rib 55*a* includes a base 55*a*1, an intermediate portion 55*a*2, and a regulating portion 55*a*3. The first guide rib 55*a* is formed such that the base 55*a*1, intermediate portion 55*a*2, and regulating portion 55*a*3 are arranged in this order in the lengthwise direction (X-axis direction) of the body decorative panel 11 from the closest short-side wall 11*b* to the short-side wall 11*b* on the opposite side. The second guide rib 55*b* includes a base 55*b*1, an intermediate portion 55*b*2, and a regulating portion 55*b*3. The second guide rib 55*b* is formed such that the base 55*b*1, intermediate portion 55*b*2, and regulating portion 55*b*3 are arranged in this order in the lengthwise direction (X-axis direction) of the body decorative panel 11 from the closest short-side wall 11*b* to the short-side wall 11*b* on the opposite side. The first guide rib 55*a* and second guide rib 55*b*, which are formed in a plate-like shape, can reduce the amount of material to be used and thereby reduce material cost.

The bases 55*a*1 and 55*b*1 are provided in the widthwise direction (Y-axis direction) of the body decorative panel 11 in a planar view. The base 55*a*1 is fixed to the long-side wall 11*a* and the base 55*b*1 is fixed to the inner wall 11*d*.

The regulating portion 55*a*3, which is a front end portion of the first guide rib 55*a*, is provided to be opposite to the long-side wall 11*a*. The regulating portion 55*b*3, which is a front end portion of the second guide rib 55*b*, is provided to be opposite to the inner wall 11*d*. A regulating surface 55*a*4 of the regulating portion 55*a*3 and regulating surface 55*b*4 of the regulating portion 55*b*3 are configured to be opposite to each other. The pair of guide ribs 55 are disposed such that a width W2 between the regulating surfaces 55*a*4 and 55*b*4 is equal to or slightly smaller than the width W4 of the rail 21.

The intermediate portion 55*a*2 connects the base 55*a*1 and regulating portion 55*a*3 with each other and is connected to the regulating portion 55*a*3 at an angle θ1. The intermediate portion 55*b*2 connects the base 55*b*1 and regulating portion 55*b*3 with each other and is connected to the regulating portion 55*b*3 at an angle θ2. The angles θ1 and θ2 are larger than 0 degrees and smaller than 90 degrees. Thus, the intermediate portions 55*a*2 and 55*b*2 are provided at angles to the short-side wall 11*b* in a planar view. Besides, regarding a width between the intermediate portions 55*a*2 and 55*b*2, a maximum width W3 between the intermediate portions 55*a*2 and 55*b*2 is located on the side of the closest knockout portion 14. The maximum width W3 between the intermediate portions 55*a*2 and 55*b*2 is configured to be larger than the width W2 between the regulating surfaces 55*a*4 and 55*b*4. In other words, the pair of guide ribs 55 are arranged at a distance from each other, the distance increasing as the distance to the knockout portion 14 closest to the pair of guide ribs 55 decreases. Also, the maximum width W3 between the intermediate portions 55*a*2 and 55*b*2 is configured to be larger than the width W1 of the through-hole 18 in the knockout portion 14. Although the intermediate portion 55*a*2 is illustrated as being a flat plate in FIG. 14, the intermediate portion 55*a*2 may be structured to connect the base 55*a*1 and regulating portion 55*a*3 with each other by having an arc shape in a planar view. Also, although the intermediate portion 55*b*2 is illustrated as being a flat plate, the intermediate portion 55*b*2 may be structured to connect the base 55*b*1 and regulating portion 55*b*3 with each other by forming an arc.

As described above, the pair of guide ribs 55 of the air-conditioning apparatus according to Embodiment 2 of the present invention comprise the first guide rib 55*a* fixed to the long-side wall 11*a* and the second guide rib 55*b* fixed to the inner wall 11*d* opposite to the long-side wall 11*a*. Also, the guide ribs 55, which are made of an elastic material such as a resinous material, are deformable under pressure in the insertion direction of the rails 21. Consequently, even if an angle or position of insertion of the rail 21 into the pair of guide ribs 55 deviates, the pair of guide ribs 55 can catch the rail 21 by elastic force and lead the rail 21 to an appropriate position by restoring force. Then, the rail 21 placed in the appropriate position by restoring force is restricted from moving in the width direction (Y-axis direction) of the rails 21 in the coupled body decorative panel 11. Consequently, since the movement of the rails 21, which act as coupling portions between the body decorative panel 11 and auxiliary decorative panels 20, is restricted in the width direction, the ceiling concealed indoor unit 100 and air-conditioning apparatus 1 can be provided as products with high accuracy of assembling between the body decorative panel 11 and auxiliary decorative panels 20.

Also, the ceiling concealed indoor unit 100 and air-conditioning apparatus 1 are configured such that the pair of guide ribs 55 are provided at a distance from each other, the distance increasing as the distance to the knockout portion 14 closest to the pair of guide ribs 55 in the lengthwise direction (X-axis direction) of the body decorative panel 11 decreases. This makes it easy for the user to insert the rails 21 into the body decorative panel 11 through the through-holes 18 and possible for the user to guide the rails 21 accurately into place using the pairs of guide ribs 15. This in turn can provide the ceiling concealed indoor unit 100 and air-conditioning apparatus 1 that allow the user to assemble the body decorative panel 11 and auxiliary decorative panels 20 with high assembly efficiency.

Note that embodiments of the present invention are not limited to Embodiments 1 and 2 described above, and various changes can be made. For example, in FIGS. 2 and 3, the ceiling concealed indoor unit 100 includes the auxiliary decorative panels 20 coupled to opposite ends of the body decorative panel 11 in the lengthwise direction (X-axis direction) of the ceiling concealed indoor unit 100. However, the ceiling concealed indoor unit 100 may include an auxiliary decorative panel 20 coupled to only one end of the body decorative panel 11 in the lengthwise direction (X-axis direction) of the ceiling concealed indoor unit 100. Alternatively, the ceiling concealed indoor unit 100 may include an auxiliary decorative panel 20 coupled to the body decorative panel 11 in the widthwise direction (Y-axis direction) of the ceiling concealed indoor unit 100.

Also, description has been given of a configuration in which the knockout portions 14 provided in the short-side walls 11*b* are provided in positions opposite to each. However, the knockout portions 14 may be provided in different formation positions in the widthwise direction (Y-axis direction) of the body decorative panel 11 at the short-side walls 11*b* opposite to each other or may be provided in positions not opposite to each other.

REFERENCE SIGNS LIST

1 air-conditioning apparatus 10 body 11 body decorative panel 11*a* long-side wall 11*b* short-side wall 11*b*1 inside surface 11*c* bottom face portion 11*d* inner wall 12 air outlet 12*a* airflow direction flap 13 suction port 14 knockout portion 14*b* removable plate 14*c* groove 15 guide rib 15*a* guide rib 15*a*1 base 15*a*2 intermediate portion 15*a*3 regulating portion 15*a*4 regulating surface 15*b* guide rib 15*b*1 base 15*b*2 intermediate portion 15*b*3 regulating portion 15*b*4 regulating surface 17 mounting hole 18 through-hole 19 boss 19*a* screw hole 20 auxiliary decorative panel 20*a* long-side wall 20*b* short-side wall 20*c* bottom face portion 20*d* side wall 21 rail 21*a* base end portion 21*b* front end portion 21*c* ceiling wall 21*c* ceiling surface 21*c*2 ceiling protrusion 21*d* side wall 21*e* opening 22 screw 25 guide rib 35 guide rib 35*a* guide rib 35*b* guide rib 45 guide rib 45*a* guide rib 45*a*1 base 45*a*2 intermediate portion 45*a*3 regulating portion 45*a*4 regulating surface 45*b* guide rib 45*b*1 base 45*b*2 intermediate portion 45*b*3 regulating portion 55 guide rib 55*a* first guide rib 55*a*1 base 55*a*2 intermediate portion 55*a*3 regulating portion 55*a*4 regulating surface 55*b* second guide rib 55*b*1 base 55*b*2 intermediate portion 55*b*3 regulating portion 55*b*4 regulating surface 100 ceiling concealed indoor unit 110 indoor heat exchanger 200 outdoor unit 210 compressor 220 flow switching device 230 outdoor heat exchanger 240 expansion valve 300 gas refrigerant pipe 400 liquid refrigerant pipe

The invention claimed is:

1. A ceiling concealed indoor unit for an air-conditioning apparatus comprising:

a body; and a body decorative panel installed below the body, and including:

two long-side walls opposite to each other, two short-side walls opposite to each other, and a bottom face portion, wherein the body decorative panel includes:

a pair of guide ribs disposed to be opposite to each other, between which a rail of an auxiliary decorative panel is inserted, the auxiliary decorative panel being coupled to the body decorative panel, and a plurality of knockout portions at the short-side walls, wherein the knockout portions include removable plates configured to be removed to form through-holes in the short-side walls, and grooves formed around the removable plates at the short-side walls, and wherein the pair of guide ribs are provided for each of the knockout portions and at a distance from each other, the distance increasing as a distance to one of the knockout portions closest to the pair of guide ribs decreases.

2. The ceiling concealed indoor unit of claim 1, wherein the body decorative panel is rectangular in a planar view, and wherein the pair of guide ribs is one pair of a plurality of pairs of guide ribs in a lengthwise direction of the body decorative panel.

3. The ceiling concealed indoor unit of claim 1, wherein the grooves are formed in inside surfaces of the short-side walls opposite to each other.

4. The ceiling concealed indoor unit for an air-conditioning apparatus of claim 1, further comprising the auxiliary decorative panel coupled to the body decorative panel, wherein the auxiliary decorative panel includes the rail configured to protrude from the auxiliary decorative panel, the rail being inserted between the guide ribs by passing through the through-holes.

5. The ceiling concealed indoor unit of claim 4, wherein the rail includes a ceiling wall and side walls rising from opposite ends of the ceiling wall in a cross-section perpendicular to an axial direction of the rail.

6. The ceiling concealed indoor unit of claim 5, wherein the ceiling wall further includes a ceiling protrusion protruding toward a front end of the rail and having an arc shape.

7. The ceiling concealed indoor unit of claim 1, wherein a length of the rail is larger than a distance D between the short-side walls and a mounting hole used to mount the body decorative panel on the body.

8. The ceiling concealed indoor unit of claim 1, wherein the pair of guide ribs comprise a first guide rib fixed to the long-side wall and a second guide rib fixed to an inner wall opposite to the long-side wall.

9. The ceiling concealed indoor unit of claim 8, wherein the pair of guide ribs are made of an elastic material.

10. An air-conditioning apparatus equipped with the ceiling concealed indoor unit of claim 1.

* * * * *